US009682284B2

(12) United States Patent
Isogawa et al.

(10) Patent No.: US 9,682,284 B2
(45) Date of Patent: Jun. 20, 2017

(54) GOLF BALL

(71) Applicant: DUNLOP SPORTS CO. LTD., Kobe-shi, Hyogo (JP)

(72) Inventors: Kazuhiko Isogawa, Kobe (JP); Kosuke Tachibana, Kobe (JP)

(73) Assignee: DUNLOP SPORTS CO. LTD., Kobe-shi, Hyogo (JP)

( * ) Notice: Subject to any disclaimer, the term of this patent is extended or adjusted under 35 U.S.C. 154(b) by 0 days.

(21) Appl. No.: 14/578,647

(22) Filed: Dec. 22, 2014

(65) Prior Publication Data

US 2015/0174455 A1 Jun. 25, 2015

(30) Foreign Application Priority Data

Dec. 25, 2013 (JP) ..... 2013-267871

(51) Int. Cl.
*A63B 37/00* (2006.01)

(52) U.S. Cl.
CPC ..... *A63B 37/0077* (2013.01); *A63B 37/004* (2013.01); *A63B 37/008* (2013.01); *A63B 37/0031* (2013.01); *A63B 37/0033* (2013.01); *A63B 37/0039* (2013.01); *A63B 37/0043* (2013.01); *A63B 37/0044* (2013.01); *A63B 37/0045* (2013.01); *A63B 37/0076* (2013.01); *A63B 37/0092* (2013.01)

(58) Field of Classification Search
CPC ..... A63B 37/0076
See application file for complete search history.

(56) References Cited

U.S. PATENT DOCUMENTS 4,688,801 A * 8/1987 Reiter ..... C08F 279/02 473/372
6,152,834 A 11/2000 Sullivan
6,416,425 B1 * 7/2002 Maruko ..... A63B 37/0003 473/371
6,419,595 B1 * 7/2002 Maruko ..... A63B 37/12 473/371
2008/0146376 A1 * 6/2008 Watanabe ..... A63B 37/0003 473/373
2009/0170634 A1 * 7/2009 Loper ..... A63B 37/0003 473/373
2011/0143863 A1 * 6/2011 Sullivan ..... A63B 37/0043 473/376
2012/0129630 A1 * 5/2012 Loper ..... A63B 37/0003 473/373

(Continued)

FOREIGN PATENT DOCUMENTS

JP 2009-095365 A 5/2009

*Primary Examiner* — John E Simms, Jr.
(74) *Attorney, Agent, or Firm* — Birch, Stewart, Kolasch & Birch, LLP

(57) ABSTRACT

A golf ball 2 includes a core 4, a first mid layer 10, a second mid layer 12, a third mid layer 14, and a cover 8. A volume Vinm and a Shore D hardness Hinm of the first mid layer, a volume Vm and a Shore D hardness Hm of the second mid layer, a volume Voum and a Shore D hardness Houm of the third mid layer, a volume Vc and a Shore D hardness Hc of the cover, and a volume V of an entirety of the ball meet: (a) Hinm<Hm>Houm>Hc, (b) Vinm<Vm>Voum>Vc, (c) Hm−Hc>25, (d) (Vinm+Vm+Voum+Vc)/V<0.40, (e) Vm/Vc>1.50, and (f) (Vm*Hm)/(Vc*Hc)>3.0.

16 Claims, 1 Drawing Sheet

(56) References Cited

U.S. PATENT DOCUMENTS

| | | | | |
|---|---|---|---|---|
| 2012/0129632 | A1* | 5/2012 | Sullivan | A63B 37/0031 473/376 |
| 2013/0296072 | A1* | 11/2013 | Nakajima | C08K 5/14 473/367 |
| 2013/0324315 | A1* | 12/2013 | Tachibana | A63B 37/0054 473/373 |

* cited by examiner

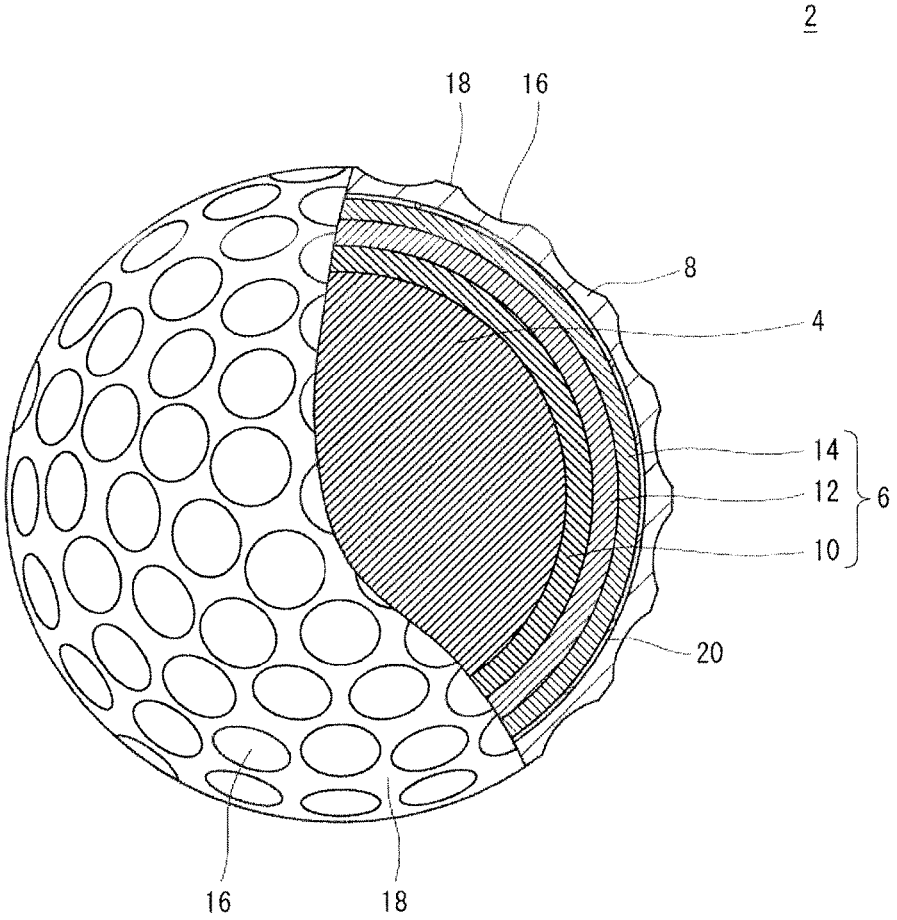
2
18
16
8
4
14
12
6
10
20
16
18

GOLF BALL

This application claims priority on Patent Application No. 2013-267871 filed in JAPAN on Dec. 25, 2013. The entire contents of this Japanese Patent Application are hereby incorporated by reference.

BACKGROUND OF THE INVENTION

Field of the Invention

The present invention relates to golf balls. Specifically, the present invention relates to golf balls that include a core, a mid layer, and a cover.

Description of the Related Art

Golf players' foremost requirement for golf balls is high flight distance performance. In particular, golf players place importance on high flight distance performance upon a shot with a driver. High flight distance performance correlates with the resilience performance of a golf ball. When a golf ball having excellent resilience performance is hit, the golf ball flies at a high speed, thereby achieving a large flight distance.

An appropriate trajectory height is required in order to achieve a large flight distance. A trajectory height depends on a spin rate and a launch angle. With a golf ball that achieves a high trajectory by a high spin rate, a flight distance is insufficient. With a golf ball that achieves a high trajectory by a high launch angle, a large flight distance is obtained. In light of flight distance, a low spin rate and a high launch angle are preferred.

Golf players also place importance on spin performance of golf balls. When a backspin rate is high, the run is short. It is easy for golf players to cause a golf ball, to which backspin is easily provided, to stop at a target point. When a sidespin rate is high, the golf ball tends to curve. It is easy for golf players to intentionally cause a golf ball, to which sidespin is easily provided, to curve. A golf ball to which spin is easily provided has excellent approach performance. In particular, advanced golf players place importance on approach performance upon a shot with a short iron.

Golf players are further interested in feel at impact of golf balls. A hard cover deteriorates feel at impact. Golf players prefer soft feel at impact.

In light of achievement of various performance characteristics, golf balls each having a multilayer structure have been proposed. JP2009-95365 discloses a golf ball that includes an inner envelope layer, an outer envelope layer, a mid layer, and a cover. The mid layer is harder than the inner envelope layer, the outer envelope layer, and the cover. JP2008-149131 (US2008/0146376) also discloses a similar golf ball. U.S. Pat. No. 6,152,834 discloses a golf ball that includes a core and a cover composed of at least three layers. In the golf ball, a soft and thick cover is formed as an outermost layer.

When a golf ball having a high launch angle and a low spin rate is hit with a driver, a large flight distance is obtained. However, a golf ball having a low spin rate has inferior approach performance. In recently years, golf players' requirements for golf balls have been escalated more than ever. A golf ball that achieves both a large flight distance and excellent approach performance on a high level is desired. Furthermore, a golf ball having soft feel at impact upon a shot is desired.

An object of the present invention is to provide a golf ball that has high flight distance performance upon a shot with a driver and excellent approach performance upon a shot with a short iron, provides favorable feel at impact, and has good durability.

SUMMARY OF THE INVENTION

A preferable golf ball according to the present invention includes a core, a mid layer positioned outside the core, and a cover positioned outside the mid layer. The mid layer includes a first mid layer, a second mid layer positioned outside the first mid layer, and a third mid layer positioned outside the second mid layer. A volume ($mm^3$) of the first mid layer is defined as Vinm; a Shore D hardness of the first mid layer is defined as Hinm; a volume ($mm^3$) of the second mid layer is defined as Vm; a Shore D hardness of the second mid layer is defined as Hm; a volume ($mm^3$) of the third mid layer is defined as Voum; a Shore D hardness of the third mid layer is defined as Houm; a volume ($mm^3$) of the cover is defined as Vc; a Shore D hardness of the cover is defined as Hc; and a volume of an entirety of the ball is defined as V. The golf ball meets the following relational expressions (a) to (f):

$$Hinm<Hm>Houm>Hc, \quad (a)$$

$$Vinm<Vm>Voum>Vc, \quad (b)$$

$$Hm-Hc>25, \quad (c)$$

$$(Vinm+Vm+Voum+Vc)/V<0.40, \quad (d)$$

$$Vm/Vc>1.50, \text{ and} \quad (e)$$

$$(Vm*Hm)/(Vc*Hc)>3.0. \quad (f)$$

In the golf ball, the hardness and the volume of each layer are set in appropriate ranges. When the golf ball is hit with a short iron, the spin rate is high. The golf ball has excellent approach performance. In the golf ball, the resilience performance of the core is not impaired. When the golf ball is hit with a driver, the spin rate is low. The excellent resilience performance and the low spin rate achieve a large flight distance. The feel at impact of the golf ball is soft. The durability of the golf ball is good.

Preferably, the golf ball meets the following relational expression (g):

$$Vc/V<0.08. \quad (g)$$

Preferably, the hardness Hc is equal to or less than 36.

Preferably, the second mid layer is formed from a resin composition. Preferably, a principal component of a base resin of the resin composition is selected from an ionomer resin, a polyamide resin, and a mixture thereof.

Preferably, the hardness Hm is equal to or greater than 68.

Preferably, a JIS-C hardness Hs at a surface of the core is greater than a JIS-C hardness Ho at a central point of the core. Preferably, a difference (Hs−Ho) between the hardness Hs and the hardness Ho is equal to or greater than 28.

Preferably, the hardness Hinm is less than the hardness Houm.

Preferably, the core is obtained by a rubber composition being crosslinked. Preferably, the rubber composition includes (A) a carboxylic acid and/or a salt thereof.

BRIEF DESCRIPTION OF THE DRAWINGS

The FIGURE is a partially cutaway cross-sectional view of a golf ball according to one embodiment of the present invention.

DESCRIPTION OF THE PREFERRED EMBODIMENTS

The following will describe in detail the present invention, based on preferred embodiments with reference to the accompanying drawing.

The FIGURE is a partially cutaway cross-sectional view of a golf ball 2 according to one embodiment of the present invention. The golf ball 2 includes a core 4, a mid layer 6 positioned outside the core 4, and a cover 8 positioned outside the mid layer 6. The core 4 is spherical.

The surface of the mid layer 6 is spherical. In the golf ball 2, the mid layer 6 is formed from a plurality of layers. The mid layer 6 includes a first mid layer 10, a second mid layer 12, and a third mid layer 14. In the golf ball 2, the mid layer 6 is composed of three layers. The mid layer 6 may include four or more layers.

The second mid layer 12 is positioned outside the first mid layer 10. The third mid layer 14 is positioned outside the second mid layer 12. The second mid layer 12 is positioned between the first mid layer 10 and the third mid layer 14. The outer surface of the first mid layer 10 is in contact with the inner surface of the second mid layer 12. The outer surface of the second mid layer 12 is in contact with the inner surface of the third mid layer 14. The first mid layer 10 is the innermost layer of the mid layer 6. The third mid layer 14 is the outermost layer of the mid layer 6.

In the golf ball 2, the cover 8 is a single layer. As described later, in the golf ball 2, a reinforcing layer is provided between the third mid layer 14 and the cover 8. The cover 8 is covered with a paint layer (not shown). The surface of the cover 8 is in contact with the paint layer.

On the surface of the cover 8, a large number of dimples 16 are formed. Of the surface of the cover 8, a part other than the dimples 16 is a land 18. The golf ball 2 includes the paint layer and a mark layer on the external side of the cover 8, but these layers are not shown in the drawing.

The golf ball 2 has a diameter of 40 mm or greater but 45 mm or less. From the standpoint of conformity to the rules established by the United States Golf Association (USGA), the diameter is preferably equal to or greater than 42.67 mm. In light of suppression of air resistance, the diameter is preferably equal to or less than 44 mm and more preferably equal to or less than 42.80 mm. The golf ball 2 has a weight of 40 g or greater but 50 g or less. In light of attainment of great inertia, the weight is preferably equal to or greater than 44 g and more preferably equal to or greater than 45.00 g. From the standpoint of conformity to the rules established by the USGA, the weight is preferably equal to or less than 45.93 g.

Preferably, the core 4 is obtained by crosslinking a rubber composition. Examples of preferable base rubbers for use in the rubber composition include polybutadienes, polyisoprenes, styrene-butadiene copolymers, ethylene-propylene-diene copolymers, and natural rubbers. In light of resilience performance, polybutadienes are preferred. When a polybutadiene and another rubber are used in combination, it is preferred if the polybutadiene is included as a principal component. Specifically, the proportion of the polybutadiene to the entire base rubber is preferably equal to or greater than 50% by weight and more preferably equal to or greater than 80% by weight. The proportion of cis-1,4 bonds in the polybutadiene is preferably equal to or greater than 40% and more preferably equal to or greater than 80%.

The rubber composition of the core 4 includes a co-crosslinking agent. The co-crosslinking agent achieves high resilience performance of the core 4. Examples of preferable co-crosslinking agents in light of resilience performance include monovalent or bivalent metal salts of an α,β-unsaturated carboxylic acid having 2 to 8 carbon atoms. A metal salt of an α,β-unsaturated carboxylic acid graft-polymerizes with the molecular chain of the base rubber, thereby crosslinking the rubber molecules. Specific examples of preferable co-crosslinking agents include zinc acrylate, magnesium acrylate, zinc methacrylate, and magnesium methacrylate. Zinc acrylate and zinc methacrylate are particularly preferred on the grounds that high resilience performance is achieved.

As a co-crosslinking agent, an α,β-unsaturated carboxylic acid having 2 to 8 carbon atoms and a metal compound may also be included. The metal compound reacts with the α,β-unsaturated carboxylic acid in the rubber composition. A salt obtained by this reaction graft-polymerizes with the molecular chain of the base rubber. Examples of preferable α,β-unsaturated carboxylic acids include acrylic acid and methacrylic acid.

Examples of preferable metal compounds include metal hydroxides such as magnesium hydroxide, zinc hydroxide, calcium hydroxide, and sodium hydroxide; metal oxides such as magnesium oxide, calcium oxide, zinc oxide, and copper oxide; and metal carbonates such as magnesium carbonate, zinc carbonate, calcium carbonate, sodium carbonate, lithium carbonate, and potassium carbonate. Metal oxides are preferred. Oxides including a bivalent metal are more preferred. An oxide including a bivalent metal reacts with the co-crosslinking agent to form metal crosslinks. Examples of particularly preferable metal oxides include zinc oxide and magnesium oxide.

In light of resilience performance of the golf ball 2, the amount of the co-crosslinking agent in the core 4 is preferably equal to or greater than 25 parts by weight and more preferably equal to or greater than 30 parts by weight, per 100 parts by weight of the base rubber. In light of soft feel at impact, the amount of the co-crosslinking agent is preferably equal to or less than 50 parts by weight and more preferably equal to or less than 45 parts by weight, per 100 parts by weight of the base rubber.

Preferably, the rubber composition of the core 4 includes an organic peroxide together with the co-crosslinking agent. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy) hexane, and di-t-butyl peroxide. In light of versatility, dicumyl peroxide is preferred.

In light of resilience performance of the golf ball 2, the amount of the organic peroxide in the core 4 is preferably equal to or greater than 0.1 parts by weight, more preferably equal to or greater than 0.3 parts by weight, and particularly preferably equal to or greater than 0.5 parts by weight, per 100 parts by weight of the base rubber. In light of soft feel at impact, the amount of the organic peroxide is preferably equal to or less than 2.0 parts by weight, more preferably equal to or less than 1.5 parts by weight, and particularly preferably equal to or less than 1.2 parts by weight, per 100 parts by weight of the base rubber.

Preferably, the rubber composition of the core 4 includes an organic sulfur compound. Examples of preferable organic sulfur compounds include monosubstitutions such as diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide, bis(4-cyanophenyl)disulfide, and the like; disubstitutions such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl) disulfide, bis(2-cyano-5-bromophenyl)disulfide, and the like; trisubstitutions such as bis(2,4,6-trichlorophenyl)disulfide, bis(2-cyano-4-chloro-6-bromophenyl)disulfide, and the like; tetrasubstitutions such as bis(2,3,5,6-tetrachlorophenyl)disulfide and the like; and pentasubstitutions such as bis(2,3,4,5,6-pentachlorophenyl)disulfide, bis(2,3,4,5,6-pentabromophenyl)disulfide, and the like. Other examples of preferable organic sulfur compounds include thionaphthols such as 2-thionaphthol, 1-thionaphthol, 2-chloro-1-thionaphthol, 2-bromo-1-thionaphthol, 2-fluoro-1-thionaphthol, 2-cyano-1-thionaphthol, 2-acetyl-1-thionaphthol, 1-chloro-2-thionaphthol, 1-bromo-2-thionaphthol, 1-fluoro-2-thionaphthol, 1-cyano-2-thionaphthol, 1-acetyl-2-thionaphthol, and the like; and metal salts thereof. The organic sulfur compound contributes to resilience performance. More preferable organic sulfur compounds are bis(pentabromophenyl)disulfide, diphenyl disulfide, and 2-thionaphthol. A particularly preferable organic sulfur compound is bis(pentabromophenyl)disulfide.

In light of resilience performance of the golf ball 2, the amount of the organic sulfur compound per 100 parts by weight of the base rubber is preferably equal to or greater than 0.10 parts by weight, more preferably equal to or greater than 0.15 parts by weight, and particularly preferably equal to or greater than 0.20 parts by weight. In light of resilience performance, the amount is preferably equal to or less than 5.0 parts by weight, more preferably equal to or less than 3.0 parts by weight, and particularly preferably equal to or less than 1.0 parts by weight.

Preferably, the rubber composition of the core 4 includes (A) a carboxylic acid and/or a salt thereof.

The carboxylic acid and/or the salt thereof (A) can react with the co-crosslinking agent. The carboxylic acid and/or the salt thereof (A) has reactivity with a cationic component. During heating and forming of the core 4, the carboxylic acid dissociates and reacts with the cationic component of the co-crosslinking agent. It is thought that within the core 4, the carboxylic acid inhibits formation of the metal crosslinks by the co-crosslinking agent. The acid component included in the carboxylic acid salt exchanges the cationic component with the co-crosslinking agent. It is inferred that during heating and forming of the core 4, the carboxylic acid salt breaks the metal crosslinks by the co-crosslinking agent.

In light of reactivity with the co-crosslinking agent, the carbon number of the carboxylic acid component in the carboxylic acid and/or the salt thereof (A) is preferably equal to or greater than 1 and more preferably equal to or greater than 4. The carbon number of the carboxylic acid component in the carboxylic acid and/or the salt thereof (A) is preferably equal to or less than 30 and particularly preferably equal to or less than 25.

Examples of preferable carboxylic acids and/or salts thereof (A) include aliphatic carboxylic acids (fatty acids) and salts thereof, and aromatic carboxylic acids and salts thereof. The rubber composition may include a saturated fatty acid and a salt thereof, or may include an unsaturated fatty acid and a salt thereof. From the standpoint that an outer-hard/inner-soft structure of the core 4 is obtained, aliphatic carboxylic acids and salts thereof, and aromatic carboxylic acids and salts thereof are preferred.

Examples of aliphatic carboxylic acids include butyric acid (C4), valeric acid (C5), caproic acid (C6), enanthic acid (C7), caprylic acid (octanoic acid) (C8), pelargonic acid (C9), capric acid (decanoic acid) (C10), lauric acid (C12), myristic acid (C14), myristoleic acid (C14), pentadecylic acid (C15), palmitic acid (C16), palmitoleic acid (C16), margaric acid (C17), stearic acid (C18), elaidic acid (C18), vaccenic acid (C18), oleic acid (C18), linolic acid (C18), linolenic acid (C18), 12-hydroxystearic acid (C18), arachidic acid (C20), gadoleic acid (C20), arachidonic acid (C20), eicosenoic acid (C20), behenic acid (C22), erucic acid (C22), lignoceric acid (C24), nervonic acid (C24), cerotic acid (C26), montanic acid (C28), and melissic acid (C30). Two or more aliphatic carboxylic acids may be used in combination. Caprylic acid (octanoic acid), lauric acid, myristic acid, palmitic acid, stearic acid, oleic acid, and behenic acid are preferred.

An aromatic carboxylic acid has an aromatic ring and a carboxyl group. Examples of aromatic carboxylic acids include benzoic acid, phthalic acid, isophthalic acid, terephthalic acid, hemimellitic acid (benzene-1,2,3-tricarboxylic acid), trimellitic acid (benzene-1,2,4-tricarboxylic acid), trimesic acid (benzene-1,3,5-tricarboxylic acid), mellophanic acid (benzene-1,2,3,4-tetracarboxylic acid), prehnitic acid (benzene-1,2,3,5-tetracarboxylic acid), pyromellitic acid (benzene-1,2,4,5-tetracarboxylic acid), mellitic acid (benzene hexacarboxylic acid), diphenic acid (biphenyl-2,2'-dicarboxylic acid), toluic acid (methylbenzoic acid), xylic acid, prehnitylic acid (2,3,4-trimethylbenzoic acid), γ-isodurylic acid (2,3,5-trimethylbenzoic acid), durylic acid (2,4,5-trimethylbenzoic acid), β-isodurylic acid (2,4,6-trimethylbenzoic acid), α-isodurylic acid (3,4,5-trimethylbenzoic acid), cuminic acid (4-isopropylbenzoic acid), uvitic acid (5-methylisophthalic acid), α-toluic acid (phenylacetic acid), hydratropic acid (2-phenylpropanoic acid), and hydrocinnamic acid (3-phenylpropanoic acid). Benzoic acid is preferred.

The carboxylic acid and/or the salt thereof (A) may be an aromatic carboxylic acid substituted with a hydroxyl group, an alkoxy group, or an oxo group. Examples of this carboxylic acid can include salicylic acid (2-hydroxybenzoic acid), anisic acid (methoxybenzoic acid), cresotinic acid (hydroxy(methyl)benzoic acid), o-homosalicylic acid (2-hydroxy-3-methylbenzoic acid), m-homosalicylic acid (2-hydroxy-4-methylbenzoic acid), p-homosalicylic acid (2-hydroxy-5-methylbenzoic acid), o-pyrocatechuic acid (2,3-dihydroxybenzoic acid), β-resorcylic acid (2,4-dihydroxybenzoic acid), γ-resorcylic acid (2,6-dihydroxybenzoic acid), protocatechuic acid (3,4-dihydroxybenzoic acid), α-resorcylic acid (3,5-dihydroxybenzoic acid), vanillic acid (4-hydroxy-3-methoxybenzoic acid), isovanillic acid (3-hydroxy-4-methoxybenzoic acid), veratric acid (3,4-dimethoxybenzoic acid), o-veratric acid (2,3-dimethoxybenzoic acid), orsellinic acid (2,4-dihydroxy-6-methylbenzoic acid), m-hemipinic acid (4,5-dimethoxyphthalic acid), gallic acid (3,4,5-trihydroxybenzoic acid), syringic acid (4-hydroxy-3,5-dimethoxybenzoic acid), asaronic acid (2,4,5-trimethoxybenzoic acid), mandelic acid (hydroxy(phenyl)acetic acid), vanillylmandelic acid (hydroxy(4-hydroxy-3-methoxyphenyl)acetic acid), homoanisic acid ((4-methoxyphenyl)acetic acid), homogentisic acid ((2,5-dihydroxyphenyl)acetic acid), homoprotocatechuic acid ((3,4-dihydroxyphenyl)acetic acid), homovanillic acid ((4-hydroxy-3-methoxyphenyl)acetic acid), homoisovanillic acid ((3-hydroxy-4-methoxyphenyl)acetic acid), homoveratric acid ((3,4-dimethoxyphenyl)acetic acid), o-homoveratric acid ((2,3-dimethoxyphenyl)acetic acid), homophthalic acid (2-(carboxymethyl)benzoic acid), homoisophthalic acid (3-(carboxymethyl)benzoic acid), homoterephthalic acid (4-

(carboxymethyl)benzoic acid), phthalonic acid (2-(carboxycarbonyl)benzoic acid), isophthalonic acid (3-(carboxycarbonyl)benzoic acid), terephthalonic acid (4-(carboxycarbonyl)benzoic acid), benzilic acid (hydroxydiphenylacetic acid), atrolactic acid (2-hydroxy-2-phenylpropanoic acid), tropic acid (3-hydroxy-2-phenylpropanoic acid), melilotic acid (3-(2-hydroxyphenyl)propanoic acid), phloretic acid (3-(4-hydroxyphenyl)propanoic acid), hydrocaffeic acid (3-(3,4-dihydroxyphenyl)propanoic acid), hydroferulic acid (3-(4-hydroxy-3-methoxyphenyl)propanoic acid), hydroisoferulic acid (3-(3-hydroxy-4-methoxyphenyl)propanoic acid), p-coumaric acid (3-(4-hydroxyphenyl)acrylic acid), umbellic acid (3-(2,4-dihydroxyphenyl)acrylic acid), caffeic acid (3-(3,4-dihydroxyphenyl)acrylic acid), ferulic acid (3-(4-hydroxy-3-methoxyphenyl)acrylic acid), isoferulic acid (3-(3-hydroxy-4-methoxyphenyl)acrylic acid), and sinapic acid (3-(4-hydroxy-3,5-dimethoxyphenyl)acrylic acid).

The cationic component included in the carboxylic acid and/or the salt thereof (A) is a metal ion or an organic cation. Examples of the metal ion include sodium ion, potassium ion, lithium ion, silver ion, magnesium ion, calcium ion, zinc ion, barium ion, cadmium ion, copper ion, cobalt ion, nickel ion, manganese ion, aluminum ion, iron ion, tin ion, zirconium ion, and titanium ion. Two or more types of ions may be used in combination. Zinc ion and magnesium ion are preferred.

The organic cation has a carbon chain. Examples of the organic cation include organic ammonium ions. Examples of organic ammonium ions include primary ammonium ions such as stearylammonium ion, hexylammonium ion, octylammonium ion, and 2-ethylhexylammonium ion; secondary ammonium ions such as dodecyl(lauryl)ammonium ion, and octadecyl(stearyl)ammonium ion; tertiary ammonium ions such as trioctylammonium ion; and quaternary ammonium ions such as dioctyldimethylammonium ion, and distearyldimethylammonium ion. Two or more types of organic cations may be used in combination.

In light of ease of the above cation exchange reaction, an aliphatic carboxylic acid salt may be used. An aliphatic carboxylic acid and an aliphatic carboxylic acid salt may be used in combination, or two or more aliphatic carboxylic acid salts may be used in combination.

Examples of preferable aliphatic carboxylic acid salts include potassium salts, magnesium salts, aluminum salts, zinc salts, iron salts, copper salts, nickel salts, and cobalt salts of octanoic acid, lauric acid, myristic acid, palmitic acid, stearic acid, oleic acid, and behenic acid. Zinc salts of carboxylic acids are particularly preferred. Specific examples of preferable carboxylic acid salts include zinc octoate, zinc laurate, zinc myristate, and zinc stearate.

In light of suppression of spin, the amount of the carboxylic acid and/or the salt thereof (A) per 100 parts by weight of the base rubber is preferably equal to or greater than 0.5 parts by weight, more preferably equal to or greater than 1.0 parts by weight, and particularly preferably equal to or greater than 2.0 parts by weight. In light of resilience performance, the amount is preferably equal to or less than 40 parts by weight, more preferably equal to or less than 30 parts by weight, and particularly preferably equal to or less than 20 parts by weight.

As the co-crosslinking agent, zinc acrylate is preferably used. Zinc acrylate whose surface is coated with stearic acid or zinc stearate for the purpose of improving dispersibility to rubber is present. When the rubber composition includes this zinc acrylate, the stearic acid or zinc stearate coating the zinc acrylate is not included in the concept of the carboxylic acid and/or the salt thereof (A).

For the purpose of adjusting specific gravity and the like, a filler may be included in the core 4. Examples of suitable fillers include zinc oxide, barium sulfate, calcium carbonate, and magnesium carbonate. Powder of a metal with a high specific gravity may be included as a filler. Specific examples of metals with a high specific gravity include tungsten and molybdenum. The amount of the filler is determined as appropriate so that the intended specific gravity of the core 4 is accomplished. A particularly preferable filler is zinc oxide. Zinc oxide serves not only as a specific gravity adjuster but also as a crosslinking activator. According to need, various additives such as sulfur, an anti-aging agent, a coloring agent, a plasticizer, a dispersant, and the like are included in the core 4 in an adequate amount. Crosslinked rubber powder or synthetic resin powder may also be included in the core 4.

Preferably, a JIS-C hardness Ho at the central point of the core 4 is equal to or greater than 40 but equal to or less than 70. The core 4 having a hardness Ho of 40 or greater can achieve excellent resilience performance. In this respect, the hardness Ho is more preferably equal to or greater than 45 and particularly preferably equal to or greater than 50. The core 4 having a hardness Ho of 70 or less suppresses excessive spin upon a shot with a driver. In this respect, the hardness Ho is more preferably equal to or less than 65 and particularly preferably equal to or less than 60. The hardness Ho is measured by pressing a JIS-C type hardness scale against the central point of a cut plane of the core 4 that has been cut into two halves. For the measurement, an automated rubber hardness measurement machine (trade name "P1", manufactured by Kobunshi Keiki Co., Ltd.), to which this hardness scale is mounted, is used.

Preferably, a JIS-C hardness Hs at the surface of the core 4 is equal to or greater than 80 but equal to or less than 96. The core 4 having a hardness Hs of 80 or greater suppresses excessive spin upon a shot with a driver. In this respect, the hardness Hs is more preferably equal to or greater than 82 and particularly preferably equal to or greater than 84. Due to the core 4 having a hardness Hs of 96 or less, excellent durability is obtained. In this respect, the hardness Hs is more preferably equal to or less than 94 and particularly preferably equal to or less than 92. The hardness Hs is measured by pressing a JIS-C type hardness scale against the surface of the core 4. For the measurement, an automated rubber hardness measurement machine (trade name "P1", manufactured by Kobunshi Keiki Co., Ltd.), to which this hardness scale is mounted, is used.

Preferably, the hardness Hs is greater than the hardness Ho. In the core 4, an outer-hard/inner-soft structure is formed. In the golf ball 2 including the core 4, a spin rate is suppressed upon a shot with a driver. In this respect, the difference (Hs−Ho) between the hardness Hs and the hardness Ho is preferably equal to or greater than 27, more preferably equal to or greater than 28, and particularly preferably equal to or greater than 30. In light of resilience performance, the difference (Hs−Ho) is preferably equal to or less than 40, more preferably equal to or less than 37, and particularly preferably equal to or less than 35.

The carboxylic acid and/or the salt thereof (A) contributes to the outer-hard/inner-soft structure of the core 4. The outer-hard/inner-soft structure can suppress a spin rate upon a shot with a driver. In light of increasing the difference (Hs−Ho), the rubber composition of the core 4 preferably includes the carboxylic acid and/or the salt thereof (A).

In light of resilience performance, the core 4 has a diameter of preferably 36.0 mm or greater and more preferably 36.5 mm or greater. The diameter of the core 4 is preferably equal to or less than 42.0 mm, more preferably equal to or less than 41.0 mm, and particularly preferably equal to or less than 40.2 mm. The core 4 preferably has a weight of 25 g or greater but 42 g or less. The temperature for crosslinking the core 4 is generally equal to or higher than 140° C. but equal to or lower than 180° C. The time period for crosslinking the core 4 is generally equal to or longer than 10 minutes but equal to or shorter than 60 minutes. The core 4 may be formed from two or more layers. For example, the core 4 may include a spherical center and an envelope layer positioned outside the center.

For the first mid layer 10, a resin composition is suitably used. Examples of the base resin of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers.

The first mid layer 10 may include a highly elastic resin. Examples of highly elastic resins include polyamide resins, polybutylene terephthalate, polyphenylene ether, polyethylene terephthalate, polysulfone, polyethersulfone, polyphenylene sulfide, polyarylate, polyamide imide, polyetherimide, polyether ether ketone, polyimide, polytetrafluoroethylene, polyamino bismaleimide, polybisamide triazole, polyphenylene oxide, polyacetal, polycarbonate, acrylonitrile-butadiene-styrene copolymers, and acrylonitrile-styrene copolymers.

Preferable base resins for the first mid layer 10 in light of resilience performance are ionomer resins or polyamide resins. The cover of the golf ball 2 is thin. When the golf ball 2 is hit, the mid layer 6 significantly deforms due to the thinness of the cover. Ionomer resins and polyamide resins are highly elastic. The first mid layer 10 including an ionomer resin or a polyamide resin contributes to resilience performance. An ionomer resin and a polyamide resin may be mixed and used.

For the second mid layer 12, a resin composition is suitably used. Examples of the base resin of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers.

The second mid layer 12 may include a highly elastic resin. Examples of highly elastic resins include polyamide resins, polybutylene terephthalate, polyphenylene ether, polyethylene terephthalate, polysulfone, polyethersulfone, polyphenylene sulfide, polyarylate, polyamide imide, polyetherimide, polyether ether ketone, polyimide, polytetrafluoroethylene, polyamino bismaleimide, polybisamide triazole, polyphenylene oxide, polyacetal, polycarbonate, acrylonitrile-butadiene-styrene copolymers, and acrylonitrile-styrene copolymers.

Preferable base resins for the second mid layer 12 in light of resilience performance are ionomer resins or polyamide resins. The cover of the golf ball 2 is thin. When the golf ball 2 is hit, the mid layer 6 significantly deforms due to the thinness of the cover. Ionomer resins and polyamide resins are highly elastic. The second mid layer 12 including an ionomer resin or a polyamide resin contributes to resilience performance. An ionomer resin and a polyamide resin may be mixed and used.

For the third mid layer 14, a resin composition is suitably used. Examples of the base resin of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers.

The third mid layer 14 may include a highly elastic resin. Examples of highly elastic resins include polyamide resins, polybutylene terephthalate, polyphenylene ether, polyethylene terephthalate, polysulfone, polyethersulfone, polyphenylene sulfide, polyarylate, polyamide imide, polyetherimide, polyether ether ketone, polyimide, polytetrafluoroethylene, polyamino bismaleimide, polybisamide triazole, polyphenylene oxide, polyacetal, polycarbonate, acrylonitrile-butadiene-styrene copolymers, and acrylonitrile-styrene copolymers.

Preferable base resins for the third mid layer 14 in light of resilience performance are ionomer resins or polyamide resins. The cover of the golf ball 2 is thin. When the golf ball 2 is hit, the mid layer 6 significantly deforms due to the thinness of the cover. Ionomer resins and polyamide resins are highly elastic. The third mid layer 14 including an ionomer resin or a polyamide resin contributes to resilience performance. An ionomer resin and a polyamide resin may be mixed and used.

As described above, an ionomer resin can be used for each of the first mid layer 10, the second mid layer 12, and the third mid layer 14. In particular, an ionomer resin can suitably be used for the second mid layer 12. Examples of preferable ionomer resins include binary copolymers formed with an α-olefin and an α,β-unsaturated carboxylic acid having 3 to 8 carbon atoms. A preferable binary copolymer includes 80% by weight or more but 90% by weight or less of an α-olefin, and 10% by weight or more but 20% by weight or less of an α,β-unsaturated carboxylic acid. The binary copolymer has excellent resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer includes 70% by weight or more but 85% by weight or less of an α-olefin, 5% by weight or more but 30% by weight or less of an α,β-unsaturated carboxylic acid, and 1% by weight or more but 25% by weight or less of an α,β-unsaturated carboxylate ester. The ternary copolymer has excellent resilience performance. For the binary copolymer and the ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid or methacrylic acid.

In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball 2 are sodium ion, zinc ion, lithium ion, and magnesium ion.

Specific examples of ionomer resins include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318", "Himilan AM7329", "Himilan AM7337", "Himilan MK7320", and "Himilan MK7329", manufactured by Du Pont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", manufactured by E.I. du Pont de Nemours and Company; and trade names "IOTEK 7010", "IOTEK 7030", "IOTEK 7510", "IOTEK 7520", "IOTEK 8000", and "IOTEK 8030", manufactured by ExxonMobil Chemical Corporation. Two or more ionomer resins may be used in combination. An ionomer resin neutralized with a monovalent metal ion, and an ionomer resin neutralized with a bivalent metal ion may be used in combination.

As described above, a polyamide resin can be used for each of the first mid layer 10, the second mid layer 12, and the third mid layer 14. In particular, a polyamide resin can suitably be used for the second mid layer 12. A polyamide resin is a polymer having a plurality of amide bonds (—NH—CO—) in the main chain thereof. Examples of polyamide resins include aliphatic polyamides, aromatic polyamides, amide copolymers, and the like. Examples of aliphatic polyamides include polyamide 6, polyamide 11, polyamide 12, polyamide 66, polyamide 610, polyamide 6T, polyamide 61, polyamide 9T, polyamide M5T, and polyamide 612. Examples of aromatic polyamides include poly-p-phenylene terephthalamide and poly-m-phenylene isophthalamide. Examples of amide copolymers include polyether block amide copolymers, polyester amide copolymers, polyether ester amide copolymers, and polyamide imide copolymers. The polyamide resin may contain two or more polyamides. Aliphatic polyamides are preferred, and polyamide 6, polyamide 11, and polyamide 12 are particularly preferred. A preferable polyamide resin in light of versatility is nylon 6.

Specific examples of polyamide resins include trade names "Novamid ST220", "Novamid 1010C2", and "Novamid ST145", manufactured by Mitsubishi Engineering-Plastics Corporation; trade name "Pebax 4033SA" manufactured by Arkema Inc.; trade names "UBE Nylon 10181", "UBE Nylon 1030J", "UBESTA P3014U", "UBESTA 3035JU6", and "UBESTA PAE1200U2", manufactured by Ube Industries, Ltd.; trade names "Zytel FN716" and "Zytel ST811HS" manufactured by E.I. du Pont de Nemours and Company; trade names "Amilan U441", "Amilan U328", and "Amilan U141", manufactured by Toray Industries Inc.; and trade name "Leona 1300S" manufactured by Asahi Kasei Corporation.

When an ionomer resin and a polyamide resin are used in combination, the ionomer resin is preferably included as the principal component of the base polymer. The proportion of the ionomer resin to the entire base polymer is preferably equal to or greater than 50% by weight, more preferably equal to or greater than 65% by weight, and particularly preferably equal to or greater than 70% by weight. The base resin including an ionomer resin and a polyamide resin may further include another resin.

According to need, a coloring agent such as titanium dioxide, a filler such as barium sulfate, a dispersant, an antioxidant, an ultraviolet absorber, a light stabilizer, a fluorescent material, a fluorescent brightener, and the like are included in the resin composition of each of the first mid layer 10, the second mid layer 12, and the third mid layer 14 in an adequate amount. Powder of a metal with a high specific gravity may be included as a filler. Specific examples of metals with a high specific gravity include tungsten and molybdenum. The amount of the filler is determined as appropriate so that the intended specific gravity of each layer of the mid layer 6 is accomplished.

The formulation of each layer of the mid layer 6 can be set in consideration of later-described conditions. In light of resilience performance, preferably, the second mid layer 12 is formed from a resin composition and the principal component of the base resin of the resin composition is selected from an ionomer resin, a polyamide resin, and a mixture thereof.

The thickness Tinm of the first mid layer 10 can be adjusted as appropriate such that conditions described later for the volume Vinm of the first mid layer 10 are met. In light of durability, the thickness Tinm is preferably equal to or greater than 0.5 mm and more preferably equal to or greater than 0.7 mm. In light of resilience performance, the thickness Tinm is preferably equal to or less than 1.2 mm and more preferably equal to or less than 1.0 mm.

The thickness Tm of the second mid layer 12 can be adjusted as appropriate such that conditions described later for the volume Vm of the second mid layer 12 are met. In light of durability, the thickness Tm is preferably equal to or greater than 0.8 mm and more preferably equal to or greater than 0.9 mm. In light of resilience performance, the thickness Tm is preferably equal to or less than 1.4 mm and more preferably equal to or less than 1.2 mm.

The thickness Toum of the third mid layer 14 can be adjusted as appropriate such that conditions described later for the volume Voum of the third mid layer 14 are met. In light of durability, the thickness Toum is preferably equal to or greater than 0.5 mm and more preferably equal to or greater than 0.7 mm. In light of resilience performance, the thickness Toum is preferably equal to or less than 1.2 mm and more preferably equal to or less than 1.0 mm.

Preferably, the mid layer 6 has an outer diameter of 40.9 mm or greater but 42.1 mm or less.

The volume Vinm of the first mid layer 10 can be adjusted as appropriate such that the later-described conditions are met. Preferably, the volume Vinm is equal to or greater than 2700 $mm^3$ but equal to or less than 4600 $mm^3$.

The volume Vm of the second mid layer 12 can be adjusted as appropriate such that the later-described conditions are met. Preferably, the volume Vm is equal to or greater than 3900 $mm^3$ but equal to or less than 5400 $mm^3$.

The volume Voum of the third mid layer 14 can be adjusted as appropriate such that the later-described conditions are met. Preferably, the volume Voum is equal to or greater than 3500 $mm^3$ but equal to or less than 4500 $mm^3$.

In light of suppression of spin upon a shot with a driver, the second mid layer 12 has a Shore D hardness Hm of preferably 68 or greater, more preferably 69 or greater, and particularly preferably 70 or greater. In light of feel at impact, the hardness Hm is preferably equal to or less than 80 and more preferably equal to or less than 76.

In the present invention, the hardness Hm of the second mid layer 12 is measured according to the standards of "ASTM-D 2240-68". For the measurement, an automated rubber hardness measurement machine (trade name "P1", manufactured by Kobunshi Keiki Co., Ltd.), to which a Shore D type hardness scale is mounted, is used. For the measurement, a sheet that is formed by hot press, is formed from the same material as that of the second mid layer 12, and has a thickness of about 2 mm is used. Prior to the measurement, a sheet is kept at 23° C. for two weeks. At the measurement, three sheets are stacked.

In light of resilience performance and durability, the first mid layer 10 has a Shore D hardness Hinm of preferably 40 or greater and more preferably 48 or greater. In light of feel at impact, the hardness Hinm is preferably equal to or less than 58 and more preferably equal to or less than 55. The hardness Hinm is measured by the same method as that for the hardness Hm.

In light of suppression of spin upon a shot with a driver, the third mid layer 14 has a Shore D hardness Houm of preferably 45 or greater and more preferably 48 or greater. In light of approach performance, the hardness Houm is preferably equal to or less than 60 and more preferably equal to or less than 55. The hardness Houm is measured by the same method as that for the hardness Hm.

For the cover 8, a resin composition is suitably used. A preferable base resin of the resin composition is a urethane resin or a urea resin. A more preferable base resin of the resin composition is a urethane resin. The principal component of the urethane resin is a polyurethane. The polyurethane is flexible. When the golf ball 2 that includes the cover 8 formed from the resin composition that includes the polyurethane is hit with a short iron, the spin rate is high. The cover 8 formed from this resin composition contributes to approach performance upon a shot with a short iron. The polyurethane also contributes to scuff resistance of the cover 8. Furthermore, the polyurethane can contribute to excellent feel at impact when the golf ball 2 is hit with a putter or a short iron.

In light of ease of forming the cover 8, a preferable base resin is a thermoplastic polyurethane elastomer. The thermoplastic polyurethane elastomer includes a polyurethane component as a hard segment, and a polyester component or a polyether component as a soft segment. Examples of isocyanates for the polyurethane component include alicyclic diisocyanates, aromatic diisocyanates, and aliphatic diisocyanates. Two or more diisocyanates may be used in combination.

Examples of alicyclic diisocyanates include 4,4'-dicyclohexylmethane diisocyanate ($H_{12}$MDI), 1,3-bis(isocyanatomethyl)cyclohexane ($H_6$XDI), isophorone diisocyanate (IPDI), and trans-1,4-cyclohexane diisocyanate (CHDI). In light of versatility and processability, $H_{12}$MDI is preferred.

Examples of aromatic diisocyanates include 4,4'-diphenylmethane diisocyanate (MDI) and toluene diisocyanate (TDI). Examples of aliphatic diisocyanates include hexamethylene diisocyanate (HDI).

Alicyclic diisocyanates are particularly preferred. Since an alicyclic diisocyanate does not have any double bond in the main chain, the alicyclic diisocyanate suppresses yellowing of the cover 8. In addition, since an alicyclic diisocyanate has excellent strength, the alicyclic diisocyanate suppresses damage of the cover 8.

Specific examples of thermoplastic polyurethane elastomers include trade names "Elastollan NY80A", "Elastollan NY82A", "Elastollan NY83A", "Elastollan NY84A", "Elastollan NY85A", "Elastollan NY88A", "Elastollan NY90A", "Elastollan NY97A", "Elastollan NY585", "Elastollan XKP016N", "Elastollan 1195ATR", "Elastollan ET890A", and "Elastollan ET88050", manufactured by BASF Japan Ltd.; and trade names "RESAMINE P4585LS" and "RESAMINE PS62490", manufactured by Dainichiseika Color & Chemicals Mfg. Co., Ltd. From the standpoint that a low hardness of the cover 8 can be achieved, "Elastollan NY80A", "Elastollan NY82A", "Elastollan NY83A", "Elastollan NY84A", "Elastollan NY85A", "Elastollan NY90A", and "Elastollan NY97A" are particularly preferred.

A thermoplastic polyurethane elastomer and another resin may be used in combination. Examples of the resin that can be used in combination include thermoplastic polyester elastomers, thermoplastic polyamide elastomers, thermoplastic polyolefin elastomers, styrene block-containing thermoplastic elastomers, and ionomer resins. When a thermoplastic polyurethane elastomer and another resin are used in combination, the thermoplastic polyurethane elastomer is included as the principal component of the base polymer, in light of spin performance and scuff resistance. The proportion of the thermoplastic polyurethane elastomer to the entire base polymer is preferably equal to or greater than 50% by weight, more preferably equal to or greater than 70% by weight, and particularly preferably equal to or greater than 85% by weight.

According to need, a coloring agent such as titanium dioxide, a filler such as barium sulfate, a dispersant, an antioxidant, an ultraviolet absorber, a light stabilizer, a fluorescent material, a fluorescent brightener, and the like are included in the cover 8 in an adequate amount.

The cover 8 preferably has a Shore D hardness Hc of 36 or less. The golf ball 2 that includes the cover 8 having a hardness Hc of 36 or less has excellent approach performance and feel at impact. In this respect, the hardness Hc is more preferably equal to or less than 30. In light of flight distance upon a shot with a driver, the hardness Hc is preferably equal to or greater than 10 and more preferably equal to or greater than 15. The hardness Hc is measured by the same method as that for the hardness Hm.

When the golf ball 2 is hit, the cover 8 including the polyurethane absorbs the shock. This absorption achieves soft feel at impact. Particularly, when the golf ball 2 is hit with a short iron or a putter, the flexible cover 8 achieves excellent feel at impact.

The thickness Tc of the cover 8 can be adjusted as appropriate such that conditions described later for the volume Vc of the cover 8 are met. In light of high flight distance performance upon a shot with a driver, the thickness Tc is preferably equal to or less than 0.6 mm. The thickness Tc is more preferably equal to or less than 0.4 mm and particularly preferably equal to or less than 0.3 mm. In light of durability and approach performance, the thickness Tc is preferably equal to or greater than 0.1 mm. The thickness Tc is measured at the land 18.

It should be noted that the volume Vc includes the volumes of the dimples 16. In calculation of the volume Vc, the outer surface of the cover 8 is regarded as a spherical surface including the surface of the land 18.

The volume Vc of the cover 8 can be adjusted as appropriate such that the later-described conditions are met. Preferably, the volume Vc is equal to or greater than 1500 $mm^3$ but equal to or less than 3200 $mm^3$.

For forming the cover 8, known methods such as injection molding, compression molding, and the like can be used. When forming the cover 8, the dimples 16 are formed by pimples formed on the cavity face of a mold.

In light of durability, the golf ball 2 that further includes a reinforcing layer 20 between the mid layer 6 and the cover 8 is preferred (see the FIGURE). The reinforcing layer 20 is positioned between the mid layer 6 and the cover 8. The reinforcing layer 20 firmly adheres to the mid layer 6 and also to the cover 8. The reinforcing layer 20 suppresses separation of the cover 8 from the mid layer 6. The golf ball 2 includes the cover 8 that is relatively thin. When the thin cover is hit with the edge of a clubface, a wrinkle is likely to occur. The reinforcing layer 20 suppresses occurrence of a wrinkle to improve the durability of the golf ball 2.

As the base polymer of the reinforcing layer 20, a two-component curing type thermosetting resin is suitably used. Specific examples of two-component curing type thermosetting resins include epoxy resins, urethane resins, acrylic resins, polyester resins, and cellulose resins. In light of strength and durability of the reinforcing layer 20, two-component curing type epoxy resins and two-component curing type urethane resins are preferred.

A two-component curing type epoxy resin is obtained by curing an epoxy resin with a polyamide type curing agent. Examples of epoxy resins used in two-component curing type epoxy resins include bisphenol A type epoxy resins, bisphenol F type epoxy resins, and bisphenol AD type epoxy resins. In light of balance among flexibility, chemical resistance, heat resistance, and toughness, bisphenol A type epoxy resins are preferred. Specific examples of the polyamide type curing agent include polyamide amine curing agents and modified products thereof. In a mixture of an epoxy resin and a polyamide type curing agent, the ratio of the epoxy equivalent of the epoxy resin to the amine active hydrogen equivalent of the polyamide type curing agent is preferably equal to or greater than 1.0/1.4 but equal to or less than 1.0/1.0.

A two-component curing type urethane resin is obtained by a reaction of a base material and a curing agent. A two-component curing type urethane resin obtained by a reaction of a base material containing a polyol component and a curing agent containing a polyisocyanate or a derivative thereof, and a two-component curing type urethane resin obtained by a reaction of a base material containing an isocyanate group-terminated urethane prepolymer and a curing agent having active hydrogen, can be used. Particularly, a two-component curing type urethane resin obtained by a reaction of a base material containing a polyol component and a curing agent containing a polyisocyanate or a derivative thereof, is preferred.

The reinforcing layer 20 may include additives such as a coloring agent (typically, titanium dioxide), a phosphate-based stabilizer, an antioxidant, a light stabilizer, a fluorescent brightener, an ultraviolet absorber, an anti-blocking agent, and the like. The additives may be added to the base material of the two-component curing type thermosetting resin, or may be added to the curing agent of the two-component curing type thermosetting resin.

The reinforcing layer 20 is obtained by applying, to the surface of the mid layer 6, a liquid that is prepared by dissolving or dispersing the base material and the curing agent in a solvent. In light of workability, application with a spray gun is preferred. After the application, the solvent is volatilized to permit a reaction of the base material with the curing agent, thereby forming the reinforcing layer 20. Examples of preferable solvents include toluene, isopropyl alcohol, xylene, methyl ethyl ketone, methyl isobutyl ketone, ethylene glycol monomethyl ether, ethylbenzene, propylene glycol monomethyl ether, isobutyl alcohol, and ethyl acetate.

In light of suppression of a wrinkle, the reinforcing layer 20 has a thickness of preferably 3 μm or greater and more preferably 5 μm or greater. In light of ease of forming the reinforcing layer 20, the thickness is preferably equal to or less than 100 μm, more preferably equal to or less than 50 μm, and further preferably equal to or less than 20 μm. The thickness is measured by observing a cross section of the golf ball 2 with a microscope. When the mid layer 6 has concavities and convexities on its surface from surface roughening, the thickness is measured at a convex part.

In light of suppression of a wrinkle, the reinforcing layer 20 has a pencil hardness of preferably 4B or greater and more preferably B or greater. In light of reduced loss of the power transmission from the cover 8 to the mid layer 6 upon hitting the golf ball 2, the pencil hardness of the reinforcing layer 20 is preferably equal to or less than 3H. The pencil hardness is measured according to the standards of "JIS K5400".

The reinforcing layer 20 may not be provided. For example, when the mid layer 6 and the cover 8 sufficiently adhere to each other so that a wrinkle is unlikely to occur, the reinforcing layer 20 may not be provided.

In light of feel at impact, the golf ball 2 has an amount of compressive deformation of preferably 2.0 mm or greater and more preferably 2.2 mm or greater. In light of resilience performance, the amount of compressive deformation of the golf ball 2 is preferably equal to or less than 3.6 mm and more preferably equal to or less than 3.2 mm.

In measurement of the amount of compressive deformation, a sphere (the golf ball 2) is placed on a hard plate made of metal. Next, a cylinder made of metal gradually descends toward the sphere. The sphere, squeezed between the bottom face of the cylinder and the hard plate, becomes deformed. A migration distance of the cylinder, starting from the state in which an initial load of 98 N is applied to the sphere up to the state in which a final load of 1274 N is applied thereto, is measured.

The golf ball 2 meets the following relational expressions (a) to (g):

$$Hinm<Hm>Houm>Hc, \quad (a)$$

$$Vinm<Vm>Voum>Vc, \quad (b)$$

$$Hm-Hc>25, \quad (c)$$

$$(Vinm+Vm+Voum+Vc)/V<0.40, \quad (d)$$

$$Vm/Vc>1.50, \quad (e)$$

$$(Vm*Hm)/(Vc*Hc)>3.0, \text{ and} \quad (f)$$

$$Vc/V<0.08. \quad (g)$$

[(a) Hinm<Hm>Houm>Hc]

The hardness Hinm of the first mid layer 10 is preferably less than the hardness Hm of the second mid layer 12. The hardness Hm is preferably greater than the hardness Houm of the third mid layer 14. The hardness Houm is preferably greater than the hardness Hc of the cover 8.

By making the hardness Hc low, approach performance improves. More preferably, the hardness Hc is less than the hardness Hinm. More preferably, the hardness Hc is the lowest among the four hardnesses Hinm, Hm, Houm, and Hc. By making the hardness Hm greater than the hardness Hinm, resilience performance improves.

In light of suppression of spin upon a shot with a driver and resilience performance, the hardness Houm is preferably greater than the hardness Hinm.

When the hardness Houm is the highest among the four hardnesses Hinm, Hm, Houm, and Hc, feel at impact becomes hard. When the cover 8 is made thick in order to avoid this hard feel at impact, flight distance performance upon a shot with a driver can be decreased. The hardness order in the above (a) contributes to achievement of both desired flight distance performance and desired feel at impact.

The golf ball 2 is likely to greatly deform in the vicinity of the surface thereof. In the vicinity of the golf ball 2, the hardness of the golf ball 2 is lower in order of the second mid layer 12, the third mid layer 14, and the cover 8. In other words, in the golf ball 2, the hardness does not sharply change at a portion that is likely to greatly deform. When the golf ball 2 is hit, no local load is easily applied thereto. The golf ball 2 has excellent durability.

[(b) Vinm<Vm>Voum>Vc]

The volume Vinm of the first mid layer 10 is preferably less than the volume Vm of the second mid layer 12. The volume Vm is preferably greater than the volume Voum of the third mid layer 14. The volume Voum is preferably greater than the volume Vc of the cover 8.

By making the volume Vc low, even with the flexible cover 8, resilience performance is not impaired. More preferably, the volume Vc is less than the volume Vinm. More preferably, the volume Vc is the lowest among the four volumes Vinm, Vm, Voum, and Vc. By making the volume Vm greater than the volume Vinm, resilience performance improves. In light of suppression of spin upon a shot with a driver and resilience performance, the volume Voum is preferably greater than the volume Vinm.

When the volume Voum is the highest among the four volumes Vinm, Vm, Voum, and Vc and the hardness Houm is greater than the hardness Hc, feel at impact becomes hard. When the cover 8 is made thick in order to avoid this hard feel at impact, flight distance performance upon a shot with a driver can be decreased. The volume order in the above (b) contributes to achievement of both desired flight distance performance and desired feel at impact.

In the golf ball 2, the first mid layer 10, the second mid layer 12, the third mid layer 14, and the cover 8 are arranged in appropriate balance from the outer side of the core 4 to the ball surface. In the golf ball 2 which is a sphere, variation of the volume of each layer greatly influences various performance characteristics. In the golf ball 2 according to the present invention, the first mid layer 10, the second mid layer 12, the third mid layer 14, and the cover 8 are arranged on the basis of the volume of each layer. In the golf ball 2, both high flight distance performance and approach performance can be achieved on a high level without impairing feel at impact and durability.

The volume order in the above (b) corresponds to the hardness order in the above (a). Due to the volume order in the above (b) and the hardness order in the above (a), a synergistic effect is achieved. The synergistic effect contributes to achievement of both desired flight distance performance and desired feel at impact.

[(C) Hm−Sc>25]

The difference (Hm−Hc) between the hardness Hm of the second mid layer 12 and the hardness Hc of the cover 8 is preferably greater than 25. In the golf ball 2 in which this condition is met, a spin rate can be sufficiently suppressed upon a shot with a driver. When the golf ball 2 is hit with a driver, the flight distance is large. In this respect, the difference (Hm−Hc) is more preferably equal to or greater than 27 and particularly preferably equal to or greater than 35. In light of durability, the difference (Hm−Hc) is preferably equal to or less than 55 and more preferably equal to or less than 50.

[Houm−Hc]

In light of achievement of both desired approach performance and desired resilience performance, the difference (Houm−Hc) between the hardness Houm of the third mid layer 14 and the hardness Hc of the cover 8 is preferably equal to or greater than 10, more preferably equal to or greater than 15, and particularly preferably equal to or greater than 20. When the preferable range of the difference (Hm−Hc) is taken into consideration, the difference (Houm−Hc) is preferably equal to or less than 40, more preferably equal to or less than 35, and particularly preferably equal to or less than 30.

[(d) (Vinm+Vm+Voum+Vc)/V<0.40]

The total sum of the volume Vinm of the first mid layer 10, the volume Vm of the second mid layer 12, the volume Voum of the third mid layer 14, and the volume Vc of the cover 8 is taken into consideration. The ratio [(Vinm+Vm+Voum+Vc)/V] of the total sum (Vinm+Vm+Voum+Vc) relative to the volume V of the golf ball 2 is taken into consideration. The ratio [(Vinm+Vm+Voum+Vc)/V] is preferably less than 0.40. In the golf ball 2, when a sufficiently large core 4 is formed, excellent resilience performance of the core 4 can be exerted. In this respect, the ratio [(Vinm+Vm+Voum+Vc)/V] is preferably equal to or less than 0.38 and more preferably equal to or less than 0.36. In light of balance between the total volume of the mid layer 6 and the cover 8 and the volume of the core 4, the ratio [(Vinm+Vm+Voum+Vc)/V] is preferably equal to or greater than 0.28 and more preferably equal to or greater than 0.30.

It should be noted that the volume V of the golf ball 2 includes the volumes of the dimples 16. In calculation of the volume V, the outer surface of the cover 8 is regarded as a spherical surface including the surface of the land 18.

[(e) Vm/Vc>1.50]

The ratio (Vm/Vc) of the volume Vm of the second mid layer 12 relative to the volume Vc of the cover 8 is preferably greater than 1.50. In the golf ball 2, the most flexible cover 8 and the second mid layer 12 harder than the cover 8 are arranged in a well-balanced manner. In the golf ball 2, although the cover 8 is flexible, a spin rate can be sufficiently suppressed upon a shot with a driver. In this respect, the ratio (Vm/Vc) is more preferably equal to or greater than 1.70 and particularly preferably equal to or greater than 2.50. In light of balance between the cover 8 and the second mid layer 12, Vm/Vc is preferably equal to or less than 3.5 and more preferably equal to or less than 3.0.

[Voum/Vc]

The ratio (Voum/Vc) of the volume Voum of the third mid layer 14 relative to the volume Vc of the cover 8 is preferably equal to or greater than 1.20 and more preferably equal to or greater than 1.30. In the golf ball 2, the most flexible cover 8 and the third mid layer 14 harder than the cover 8 are arranged in a well-balanced manner. The third mid layer 14 does not impair an effect caused by the second mid layer 12. Although the cover 8 is flexible, the golf ball 2 has excellent resilience performance. In light of balance between the third mid layer 14 and the cover 8, Voum/Vc is preferably equal to or less than 3.50.

[(f) (Vm*Hm)/(Vc*Hc)>3.0]

Regarding the second mid layer 12, the product (Vm*Hm) of the volume Vm and the hardness Hm is an overall index that reflects the volume and the hardness. Regarding the cover 8, the product (Vc*Hc) of the volume Vc and the hardness Hc is an overall index that reflects the volume and the hardness.

Preferably, the product (Vm*Hm) and the product (Vc*Hc) meet the following relationship (f).

$$(Vm*Hm)/(Vc*Hc)>3.0 \quad \text{(f)}$$

In other words, a ratio [(Vm*Hm)/(Vc*Hc)] is greater than 3.0. In the golf ball 2, the balance between the second mid layer 12 and the cover 8 is appropriate. In the golf ball 2, although the cover 8 is flexible, a spin rate can be sufficiently suppressed upon a shot with a driver. In this respect, the ratio [(Vm*Hm)/(Vc*Hc)] is more preferably equal to or greater than 4.0 and particularly preferably equal to or greater than 6.0. In light of balance between the second mid layer 12 and the cover 8, (Vm*Hm)/(Vc*Hc) is preferably equal to or less than 9.5 and more preferably equal to or less than 8.5.

[(g) Vc/V<0.08]

Preferably, the ratio (Vc/V) of the volume Vc of the cover 8 relative to the volume V of the golf ball 2 is less than 0.08. In the golf ball 2, suppression of spin upon a shot with a driver is not impaired due to the presence of the flexible cover 8. In this respect, the ratio (Vc/V) is preferably equal to or less than 0.07 and particularly preferably equal to or less than 0.04. In light of durability, the ratio (Vc/V) is preferably equal to or greater than 0.01.

The hardness Hc of the cover 8 of the golf ball 2 is less than the hardness Hm of the second mid layer 12 and less than the hardness Houm of the third mid layer 14. When the golf ball 2 is hit with a driver, a sphere consisting of the core 4 and the mid layer 6 becomes significantly distorted since the head speed is high. In the core 4, the outer-hard/inner-soft structure is formed. The core 4 suppresses a spin rate. The golf ball 2 is launched at a high speed due to deformation and restoration of the core 4. The suppression of the spin rate and the high launch speed achieve a large flight distance. When the golf ball 2 is hit with a short iron, the sphere consisting of the core 4 and the mid layer 6 becomes less distorted since the head speed is low. When the golf ball 2 is hit with a short iron, the behavior of the golf ball 2 mainly depends on the cover 8. In the golf ball 2, since the cover 8 is flexible, a slip between the golf ball 2 and a clubface is suppressed. Due to the suppression of the slip, a high spin rate is obtained. The high spin rate achieves excellent approach performance.

EXAMPLES

The following will show the effects of the present invention by means of Examples, but the present invention should not be construed in a limited manner based on the description of these Examples.

Example 1

Type 1 in Table 1 was used as the composition of a core. A rubber composition was obtained by kneading 100 parts by weight of a high-cis polybutadiene (trade name "BR-730", manufactured by JSR Corporation), 33 parts by weight of zinc diacrylate (trade name "Sanceler SR", manufactured by SANSHIN CHEMICAL INDUSTRY CO., LTD.), 5 parts by weight of zinc oxide, an appropriate amount of barium sulfate, 5 parts by weight of benzoic acid (manufactured by Tokyo Chemical Industry Co., Ltd.), 0.8 parts by weight of dicumyl peroxide (trade name "Percumyl D", manufactured by NOF Corporation), and 0.5 parts by weight of bis (pentabromophenyl)disulfide (PBDS, manufactured by Kawaguchi Chemical Industry Co., Ltd.). This rubber composition was placed into a mold including upper and lower mold halves each having a hemispherical cavity, and heated at 150° C. for 20 minutes to obtain a spherical core with a diameter of 36.9 mm. The amount of barium sulfate was adjusted such that the weight of a golf ball is 45.6 g.

Type f in Table 2 was used as the composition of a first mid layer. A resin composition was obtained by kneading 26 parts by weight of an ionomer resin (the aforementioned "Himilan AM7337"), 35 parts by weight of another ionomer resin (the aforementioned "Himilan AM7329"), 16 parts by weight of an ethylene-methacrylic acid copolymer (trade name "NUCREL N1050H", manufactured by Du Pont-MITSUI POLYCHEMICALS Co., Ltd.), 23 parts by weight of a styrene block-containing thermoplastic elastomer (trade name "Rabalon T3221C", manufactured by Mitsubishi Chemical Corporation), and 3 parts by weight of titanium dioxide with a twin-screw kneading extruder. The extruding conditions were a screw diameter of 45 mm, a screw rotational speed of 200 rpm, screw L/D of 35, and a die temperature of 160 to 230° C. The core was placed into a mold. The resin composition was injected around the core by injection molding to form a first mid layer with a thickness of 0.8 mm.

Type a in Table 2 was used as the composition of a second mid layer. A resin composition was obtained by kneading 50 parts by weight of an ionomer resin (the aforementioned "Surlyn 8150"), 50 parts by weight of another ionomer resin (the aforementioned "Surlyn 9150"), and 3 parts by weight of titanium dioxide with a twin-screw kneading extruder under the above extruding conditions. The sphere consisting of the core and the first mid layer was placed into a mold. The resin composition was injected around the sphere by injection molding to form a second mid layer with a thickness of 1.0 mm.

Type e in Table 2 was used as the composition of a third mid layer. A resin composition was obtained by kneading 31.5 parts by weight of an ionomer resin (the aforementioned "Himilan AM7337"), 38.5 parts by weight of another ionomer resin (the aforementioned "Himilan AM7329"), 16 parts by weight of an ethylene-methacrylic acid copolymer (trade name "NUCREL N1050H", manufactured by Du Pont-MITSUI POLYCHEMICALS Co., Ltd.), 14 parts by weight of a styrene block-containing thermoplastic elastomer (the aforementioned "Rabalon T3221C"), and 3 parts by weight of titanium dioxide with a twin-screw kneading extruder under the above extruding conditions. The sphere consisting of the core, the first mid layer, and the second mid layer was placed into a mold. The resin composition was injected around the sphere by injection molding to form a third mid layer with a thickness of 0.8 mm.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type solid epoxy resin and 70 parts by weight of a solvent. The curing agent liquid of this paint composition includes 40 parts by weight of a modified polyamide amine, 55 parts by weight of a solvent, and 5 parts by weight of titanium dioxide. The weight ratio of the base material liquid to the curing agent liquid is 1/1. This paint composition was applied to the surface of the third mid layer with an air gun, and kept at 23° C. for 12 hours to obtain a reinforcing layer with a thickness of 7 μm.

Type A in Table 3 was used as the composition of a cover. A resin composition was obtained by kneading 100 parts by weight of a thermoplastic polyurethane elastomer (the aforementioned "Elastollan NY82A"), 0.2 parts by weight of a hindered amine light stabilizer (trade name "TINUVIN 770", manufactured by Ciba Japan K.K.), 4 parts by weight of titanium dioxide, and 0.04 parts by weight of ultramarine blue with a twin-screw kneading extruder under the above extruding conditions. Half shells were formed from this resin composition by compression molding. The sphere consisting of the core, the first mid layer, the second mid layer, the third mid layer, and the reinforcing layer was covered with two of these half shells. The sphere and the half shells were placed into a final mold that includes upper and lower mold halves each having a hemispherical cavity and that has a large number of pimples on its cavity face. A cover was obtained by compression molding. The thickness of the cover was 0.3 mm. Dimples having a shape that is the inverted shape of the pimples were formed on the cover. The surface of the cover was polished. A clear paint including a two-component curing type polyurethane as a base material was applied to this cover with an air gun, and was dried and cured to obtain a golf ball of Example 1 with a diameter of 42.7 mm and a weight of 45.6 g.

Examples 2 to 10 and Comparative Examples 1 to 9

Golf balls of Examples 2 to 10 and Comparative Examples 1 to 9 were obtained in the same manner as Example 1, except the specifications of the core, the first mid layer, the second mid layer, the third mid layer, and the cover were as shown in Tables 4 to 7 below. The rubber composition of the core is shown in detail in Table 1 below. The resin composition of the mid layer is shown in detail in Table 2 below. The resin composition of the cover is shown in detail in Table 3 below. The mid layer of the golf ball according to Comparative Example 5 is composed of two layers. Comparative Example 5 does not have a third mid layer. The mid layer of the golf ball according to Comparative Example 7 is composed of two layers. Comparative Example 7 does not have a first mid layer. In Example 6, of the first, second, and third mid layers, only the second mid layer includes a polyamide resin.

[Resilience Coefficient]

A metallic cylinder having a weight of 198.4 g was caused to collide against a golf ball at a speed of 45 m/sec. The speeds of the metallic cylinder and the golf ball before and after the collision were measured, and a resilience coefficient was calculated based on the speeds. An average value obtained for 12 golf balls is shown as an index in Tables 8 to 11 below. The higher the index is, the more excellent the resilience performance of the golf ball is.

[Shot with Driver (W #1)]

A driver with a titanium head (trade name "XXIO", manufactured by DUNLOP SPORTS CO. LTD., shaft hardness: S, loft angle: 10.0°) was attached to a swing machine manufactured by Golf Laboratories, Inc. A golf ball was hit under the condition of a head speed of 45 m/sec. The backspin rate immediately after the hit and the flight distance from the launch point to the stop point were measured. The average value of data obtained by 10 measurements is shown in Tables 8 to 11 below.

[Hit with Sand Wedge (SW)]

A sand wedge (trade name "XXIO", manufactured by DUNLOP SPORTS CO. LTD., shaft hardness: R, loft angle: 56.0°) was attached to a swing machine manufactured by True Temper Co. A golf ball was hit under the condition of a head speed of 21 m/sec. The backspin rate was measured immediately after the hit. The average value of data obtained by 10 measurements is shown in Tables 8 to 11 below.

[Durability]

A driver with a titanium head (trade name "XXIO", manufactured by DUNLOP SPORTS CO. LTD., shaft hardness: S, loft angle: 10.0°) was attached to a swing robot M/C manufactured by True Temper Co. A golf ball having been kept at 23° C. for 12 hours was used for the measurement. The golf ball was repeatedly hit under the condition of a head speed of 45 m/sec. The number of hits required to break the golf ball was measured. An average value obtained for 12 golf balls is shown as an index in Tables 8 to 11 below. The higher the index is, the more excellent the durability of the golf ball is.

[Feel at Impact]

A golf player hit golf balls with a driver (trade name "XXIO", manufactured by DUNLOP SPORTS CO. LTD., shaft hardness: S, loft angle: 10.0°) and categorized the evaluation on the basis of the following criteria. The results are shown in Tables 8 to 11 below.

A: very favorable (soft)
B: favorable (slightly soft)
C: slightly poor (slightly hard)
D: poor (hard)

TABLE 1

Composition of Core

| Type | 1 | 2 | 3 | 4 | 5 |
|---|---|---|---|---|---|
| BR-730 | 100 | 100 | 100 | 100 | 100 |
| Sanceler SR | 33 | 32 | 31 | 32 | 34 |
| Zinc oxide | 5 | 5 | 5 | 5 | 5 |
| Barium sulfate | * | * | * | * | * |
| Benzoic acid | 5 | 3 | 1 | 5 | 5 |
| Dicumyl peroxide | 0.8 | 0.8 | 0.8 | 0.8 | 0.8 |
| PBDS | 0.5 | 0.5 | 0.5 | 0.5 | 0.5 |

* Appropriate amount

The details of the compounds listed in Table 1 are as follows.

BR-730: a high-cis polybutadiene manufactured by JSR Corporation (cis-1,4-bond content: 96% by weight, 1,2-vinyl bond content: 1.3% by weight, Mooney viscosity ($ML_{1+4}$ (100° C.)): 55, molecular weight distribution (Mw/Mn): 3)

Sanceler SR: zinc diacrylate manufactured by SANSHIN CHEMICAL INDUSTRY CO., LTD. (a product coated with 10% by weight of stearic acid)

Zinc oxide: trade name "Ginrei R", manufactured by Toho Zinc Co., Ltd.

Barium sulfate: trade name "Barium Sulfate BD", manufactured by Sakai Chemical Industry Co., Ltd.

Benzoic acid: a product of Tokyo Chemical Industry Co., Ltd.

Dicumyl peroxide: trade name "Percumyl D", manufactured by NOF Corporation

PBDS: bis(pentabromophenyl)disulfide manufactured by Kawaguchi Chemical Industry Co., Ltd.

TABLE 2

Composition and Hardness of Mid Layer

| Type | a | b | c | d | e | f | g |
|---|---|---|---|---|---|---|---|
| Surlyn 8150 | 50 | 32.5 | — | — | — | — | — |
| Surlyn 9150 | 50 | 32.5 | — | — | — | — | — |
| Nylon 6 | — | 35 | — | — | — | — | — |
| Himilan AM7337 | — | — | 55 | 38 | 31.5 | 26 | 24 |
| Himilan AM7329 | — | — | 45 | 40 | 38.5 | 35 | 30 |
| NUCREL N1050H | — | — | — | 16 | 16 | 16 | 16 |
| Rabalon T3221C | — | — | — | 6 | 14 | 23 | 30 |
| Titanium dioxide | 3 | 3 | 3 | 3 | 3 | 3 | 3 |
| Hardness (Shore D) | 70 | 72 | 65 | 60 | 55 | 50 | 45 |

The details of the compounds listed in Table 2 are as follows.

Nylon 6: a polyamide resin manufactured by Toray Industries Inc.

Titanium dioxide: a product of Ishihara Sangyo Kaisha, Ltd.

TABLE 3

| Composition and Hardness of Cover | | | |
|---|---|---|---|
| Type | A | B | C |
| Elastollan NY82A | 100 | — | — |
| Elastollan NY85A | — | 50 | — |
| Elastollan NY90A | — | 50 | — |
| Elastollan NY97A | — | — | 100 |
| TINUVIN 770 | 0.2 | 0.2 | 0.2 |
| Titanium dioxide | 4 | 4 | 4 |
| Ultramarine blue | 0.04 | 0.04 | 0.04 |
| Hardness (Shore D) | 29 | 36 | 47 |

TABLE 4

| Configuration of Golf Ball | | | | | | |
|---|---|---|---|---|---|---|
| | | Ex. 1 | Ex. 2 | Ex. 3 | Ex. 4 | Comp. Ex.1 |
| Core | Composition | 1 | 2 | 3 | 1 | 1 |
| | Vulc. Temp. (° C.) | 150 | 150 | 150 | 150 | 150 |
| | Vulc. time (min) | 20 | 20 | 20 | 20 | 20 |
| | Diameter I (mm) | 36.9 | 36.9 | 36.9 | 36.9 | 36.9 |
| Core hardness | Ho (JIS-C) | 55 | 57 | 59 | 55 | 55 |
| | Hs (JIS-C) | 89 | 87 | 86 | 89 | 89 |
| | (Hs-Ho) | 34 | 30 | 27 | 34 | 34 |
| First mid layer | Composition | f | f | f | f | f |
| | Hinm (Shore D) | 50 | 50 | 50 | 50 | 50 |
| | Diameter II (mm) | 38.5 | 38.5 | 38.5 | 38.5 | 38.5 |
| | Tinm (mm) | 0.8 | 0.8 | 0.8 | 0.8 | 0.8 |
| | Vinm ($mm^3$) | 3571 | 3571 | 3571 | 3571 | 3571 |
| Second mid layer | Composition | a | a | a | a | a |
| | Hm (Shore D) | 70 | 70 | 70 | 70 | 70 |
| | Diameter III (mm) | 40.5 | 40.5 | 40.5 | 40.5 | 40.5 |
| | Tm (mm) | 1.0 | 1.0 | 1.0 | 1.0 | 1.0 |
| | Vm ($mm^3$) | 4900 | 4900 | 4900 | 4900 | 4900 |
| Third mid layer | Composition | e | e | e | e | e |
| | Houm (Shore D) | 55 | 55 | 55 | 55 | 55 |
| | Diameter IV (mm) | 42.1 | 42.1 | 42.1 | 42.1 | 42.1 |
| | Toum (mm) | 0.8 | 0.8 | 0.8 | 0.8 | 0.8 |
| | Voum ($mm^3$) | 4285 | 4285 | 4285 | 4285 | 4285 |
| Cover | Composition | A | A | A | B | C |
| | Hc (Shore D) | 29 | 29 | 29 | 36 | 47 |
| | Tc (mm) | 0.3 | 0.3 | 0.3 | 0.3 | 0.3 |
| | Vc ($mm^3$) | 1694 | 1694 | 1694 | 1694 | 1694 |

TABLE 5

| Configuration of Golf Ball | | | | | | |
|---|---|---|---|---|---|---|
| | | Ex.5 | Comp. Ex.2 | Comp. Ex.3 | Ex.6 | Comp. Ex.4 |
| Core | Composition | 1 | 1 | 1 | 4 | 5 |
| | Vulc. temp. (° C.) | 150 | 150 | 150 | 150 | 150 |
| | Vulc. time (min) | 20 | 20 | 20 | 20 | 20 |
| | Diameter I (mm) | 36.5 | 35.7 | 36.9 | 36.9 | 36.9 |
| Core hardness | Ho (JIS-C) | 55 | 55 | 55 | 54 | 56 |
| | Hs (JIS-C) | 89 | 89 | 89 | 88 | 90 |
| | (Hs-Ho) | 34 | 34 | 34 | 34 | 34 |
| First mid layer | Composition | f | f | f | f | f |
| | Hinm (Shore D) | 50 | 50 | 50 | 50 | 50 |
| | Diameter II (mm) | 38.1 | 37.3 | 38.5 | 38.5 | 38.9 |
| | Tinm (mm) | 0.8 | 0.8 | 0.8 | 0.8 | 1.0 |
| | Vinm ($mm^3$) | 3495 | 3347 | 3571 | 3571 | 4511 |
| Second mid layer | Composition | a | a | e | b | a |
| | Hm (Shore D) | 70 | 70 | 55 | 72 | 70 |
| | Diameter III (mm) | 40.1 | 39.3 | 40.5 | 40.5 | 40.5 |

TABLE 5-continued

| Configuration of Golf Ball | | | | | | |
|---|---|---|---|---|---|---|
| | | Ex.5 | Comp. Ex.2 | Comp. Ex.3 | Ex.6 | Comp. Ex.4 |
| | Tm (mm) | 1.0 | 1.0 | 1.0 | 1.0 | 0.8 |
| | Vm ($mm^3$) | 4802 | 4607 | 4900 | 4900 | 3960 |
| Third mid layer | Composition | e | e | a | e | e |
| | Houm (Shore D) | 55 | 55 | 70 | 55 | 55 |
| | Diameter IV (mm) | 41.7 | 40.9 | 42.1 | 42.1 | 42.1 |
| | Toum (mm) | 0.8 | 0.8 | 0.8 | 0.8 | 0.8 |
| | Voum ($mm^3$) | 4203 | 4040 | 4285 | 4285 | 4285 |
| Cover | Composition | A | A | A | A | A |
| | Hc (Shore D) | 29 | 29 | 29 | 29 | 29 |
| | Tc (mm) | 0.5 | 0.9 | 0.3 | 0.3 | 0.3 |
| | Vc ($mm^3$) | 2796 | 4938 | 1694 | 1694 | 1694 |

TABLE 6

| Configuration of Golf Ball | | | | | |
|---|---|---|---|---|---|
| | | Ex. 7 | Ex. 8 | Ex. 9 | Ex. 10 |
| Core | Composition | 1 | 5 | 5 | 5 |
| | Vulc. temp.(° C.) | 150 | 150 | 150 | 150 |
| | Vulc. time(min) | 20 | 20 | 20 | 20 |
| | Diameter I(mm) | 36.9 | 36.9 | 36.9 | 36.9 |
| Core hardness | Ho (JIS-C) | 55 | 56 | 56 | 56 |
| | Hs (JIS-C) | 89 | 90 | 90 | 90 |
| | (Hs − Ho) | 34 | 34 | 34 | 34 |
| First mid layer | Composition | f | f | f | f |
| | Hinm (Shore D) | 50 | 50 | 50 | 50 |
| | Diameter II (mm) | 38.5 | 38.5 | 38.5 | 38.5 |
| | Tinm (mm) | 0.8 | 0.8 | 0.8 | 0.8 |
| | Vinm ($mm^3$) | 3571 | 3571 | 3571 | 3571 |
| Second mid layer | Composition | c | a | a | a |
| | Hm (Shore D) | 65 | 70 | 70 | 70 |
| | Diameter III (mm) | 40.5 | 40.5 | 40.5 | 40.5 |
| | Tm (mm) | 1.0 | 1.0 | 1.0 | 1.0 |
| | Vm ($mm^3$) | 4900 | 4900 | 4900 | 4900 |
| Third mid layer | Composition | e | f | g | e |
| | Houm (Shore D) | 55 | 50 | 45 | 55 |
| | Diameter IV (mm) | 42.1 | 42.1 | 42.1 | 42.1 |
| | Toum (mm) | 0.8 | 0.8 | 0.8 | 0.8 |
| | Voum ($mm^3$) | 4285 | 4285 | 4285 | 4285 |
| Cover | Composition | A | A | A | A |
| | Hc (Shore D) | 29 | 29 | 29 | 29 |
| | Tc (mm) | 0.3 | 0.3 | 0.3 | 0.3 |
| | Vc ($mm^3$) | 1694 | 1694 | 1694 | 1694 |

TABLE 7

| Configuration of Golf Ball | | | | | | |
|---|---|---|---|---|---|---|
| | | Comp. Ex.5 | Comp. Ex.6 | Comp. Ex.7 | Comp. Ex.8 | Comp. Ex.9 |
| Core | Composition | 5 | 4 | 5 | 1 | 1 |
| | Vulc. temp. (° C.) | 150 | 150 | 150 | 150 | 150 |
| | Vulc. time (min) | 20 | 20 | 20 | 20 | 20 |
| | Diameter I (mm) | 38.5 | 35.9 | 38.5 | 36.9 | 36.9 |
| Core hardness | Ho (JIS-C) | 56 | 55 | 56 | 55 | 55 |
| | Hs (JIS-C) | 90 | 89 | 90 | 89 | 89 |
| | (Hs-Ho) | 34 | 34 | 34 | 34 | 34 |
| First mid layer | Composition | f | f | — | a | f |
| | Hinm (Shore D) | 50 | 50 | — | 70 | 50 |
| | Diameter II (mm) | 40.1 | 37.7 | — | 38.5 | 38.5 |
| | Tinm (mm) | 0.8 | 0.9 | — | 0.8 | 0.8 |
| | Vinm ($mm^3$) | 3880 | 3828 | — | 3571 | 3571 |
| Second mid layer | Composition | a | a | a | e | d |
| | Hm (Shore D) | 70 | 70 | 70 | 55 | 60 |
| | Diameter III ( mm ) | 42.1 | 40.5 | 40.5 | 40.5 | 40.5 |

TABLE 7-continued

| Configuration of Golf Ball | | Comp. Ex.5 | Comp. Ex.6 | Comp. Ex.7 | Comp. Ex.8 | Comp. Ex.9 |
|---|---|---|---|---|---|---|
| | Tm (mm) | 1.0 | 1.4 | 1.0 | 1.0 | 1.0 |
| | Vm ($mm^3$) | 5305 | 6724 | 4900 | 4900 | 4900 |
| Third mid layer | Composition | — | e | e | f | e |
| | Houm (Shore D) | — | 55 | 55 | 50 | 55 |
| | Diameter IV (mm) | — | 42.1 | 42.1 | 42.1 | 42.1 |
| | Toum (mm) | — | 0.8 | 0.8 | 0.8 | 0.8 |
| | Voum ($mm^3$) | — | 4285 | 4285 | 4285 | 4285 |
| Cover | Composition | A | A | A | A | B |
| | Hc (Shore D) | 29 | 29 | 29 | 29 | 36 |
| | Tc (mm) | 0.3 | 0.3 | 0.3 | 0.3 | 0.3 |
| | Vc ($mm^3$) | 1694 | 1694 | 1694 | 1694 | 1694 |

In Tables 4 to 7, the diameter I is the diameter (mm) of the core, the diameter II is the diameter (mm) of the sphere consisting of the core and the first mid layer, the diameter III is the diameter (mm) of the sphere consisting of the core, the first mid layer, and the second mid layer, and the diameter IV is the diameter (mm) of the sphere consisting of the core, the first mid layer, the second mid layer, and the third mid layer.

TABLE 8

| Results of Evaluation | Ex. 1 | Ex. 2 | Ex. 3 | Ex. 4 | Comp. Ex. 1 |
|---|---|---|---|---|---|
| (c) (Hm − Hc) | 41 | 41 | 41 | 34 | 23 |
| (d) (Vinm + Vm + Voum + Vc)/V | 0.35 | 0.35 | 0.35 | 0.35 | 0.35 |
| (e) Vm/Vc | 2.9 | 2.9 | 2.9 | 2.9 | 2.9 |
| (f ) (Vm * Hm)/(Vc * Hc) | 7.0 | 7.0 | 7.0 | 5.6 | 4.3 |
| (g) Vc/V | 0.04 | 0.04 | 0.04 | 0.04 | 0.04 |
| Ball characteristics | | | | | |
| Deformation (mm) | 2.3 | 2.3 | 2.3 | 2.3 | 2.2 |
| Resilience coefficient | 100 | 100 | 101 | 99 | 97 |
| W#1: Spin rate (rpm) | 2700 | 2750 | 2850 | 2600 | 2500 |
| W#1: Flight distance (m) | 255 | 253 | 251 | 257 | 258 |
| SW: Spin rate (rpm) | 6900 | 6900 | 6950 | 6700 | 6450 |
| Durability | 100 | 102 | 104 | 94 | 84 |
| Feel at impact | A | A | A | B | D |

TABLE 9

| Results of Evaluation | Ex. 5 | Comp. Ex. 2 | Comp. Ex. 3 | Ex. 6 | Comp. Ex. 4 |
|---|---|---|---|---|---|
| (c) (Hm − Hc) | 41 | 41 | 26 | 43 | 41 |
| (d) (Vinm + Vm + Voum + Vc)/V | 0.38 | 0.42 | 0.35 | 0.35 | 0.35 |
| (e) Vm/Vc | 1.7 | 0.9 | 2.9 | 2.9 | 2.3 |
| (f) (Vm * Hm)/(Vc * Hc) | 4.1 | 2.3 | 5.5 | 7.2 | 5.6 |
| (g) Vc/V | 0.07 | 0.12 | 0.04 | 0.04 | 0.04 |
| Ball characteristics | | | | | |
| Deformation (mm) | 2.3 | 2.2 | 2.3 | 2.3 | 2.3 |
| Resilience coefficient | 99 | 92 | 100 | 100 | 95 |
| W#1: Spin rate (rpm) | 2800 | 3000 | 2550 | 2650 | 2850 |
| W#1: Flight distance (m) | 252 | 246 | 257 | 256 | 249 |
| SW: Spin rate (rpm) | 7000 | 7200 | 6500 | 6850 | 6950 |
| Durability | 106 | 128 | 93 | 98 | 98 |
| Feel at impact | A | A | D | B | A |

TABLE 10

| Results of Evaluation | Ex. 7 | Ex. 8 | Ex. 9 | Ex. 10 |
|---|---|---|---|---|
| (c) (Hm − Hc) | 36 | 41 | 41 | 41 |
| (d) (Vinm + Vm + Voum + Vc)/V | 0.35 | 0.35 | 0.35 | 0.35 |
| (e) Vm/Vc | 2.9 | 2.9 | 2.9 | 2.9 |
| (f) (Vm * Hm)/(Vc * Hc) | 6.5 | 7.0 | 7.0 | 7.0 |
| (g) Vc/V | 0.04 | 0.04 | 0.04 | 0.04 |
| Ball characteristics | | | | |
| Deformation (mm) | 2.3 | 2.3 | 2.4 | 2.2 |
| Resilience coefficient | 97 | 98 | 97 | 102 |
| W#1: Spin rate (rpm) | 2800 | 2750 | 2800 | 2750 |
| W#1: Flight distance (m) | 252 | 253 | 251 | 256 |
| SW: Spin rate (rpm) | 6950 | 6950 | 7000 | 6950 |
| Durability | 99 | 98 | 96 | 100 |
| Feel at impact | A | A | A | A |

TABLE 11

| Results of Evaluation | Comp. Ex. 5 | Comp. Ex. 6 | Comp. Ex. 7 | Comp. Ex. 8 | Comp. Ex. 9 |
|---|---|---|---|---|---|
| (c) (Hm − Hc) | 41 | 41 | 41 | 26 | 24 |
| (d) (Vinm + Vm + Voum + Vc)/V | 0.27 | 0.41 | 0.27 | 0.35 | 0.35 |
| (e) Vm/Vc | 3.1 | 4.0 | 2.9 | 2.9 | 2.9 |
| (f) (Vm * Hm)/(Vc * Hc) | 7.6 | 9.6 | 7.0 | 5.5 | 4.8 |
| (g) Vc/V | 0.04 | 0.04 | 0.04 | 0.04 | 0.04 |
| Ball characteristics | | | | | |
| Deformation (mm) | 2.3 | 2.3 | 2.3 | 2.3 | 2.4 |
| Resilience coefficient | 100 | 96 | 100 | 98 | 94 |
| W#1: Spin rate (rpm) | 2550 | 2800 | 2850 | 2950 | 2950 |
| W#1: Flight distance (m) | 258 | 249 | 250 | 248 | 246 |
| SW: Spin rate (rpm) | 6500 | 6900 | 6900 | 7100 | 7000 |
| Durability | 88 | 108 | 97 | 104 | 96 |
| Feel at impact | D | C | C | A | A |

As shown in Tables 8 to 11, the golf ball of each Example is excellent in high flight distance performance, approach performance, feel at impact, and durability. From the results of evaluation, advantages of the present invention are clear.

The golf ball according to the present invention can be used for playing golf on golf courses and practicing at driving ranges. The above descriptions are merely illustrative examples, and various modifications can be made without departing from the principles of the present invention.

What is claimed is:

1. A golf ball comprising a core, a mid layer positioned outside the core, and a cover positioned outside the mid layer, wherein the mid layer includes a first mid layer, a second mid layer positioned outside the first mid layer, and a third mid layer positioned outside the second mid layer, and when: a volume ($mm^3$) of the first mid layer is defined as Vinm;

a Shore D hardness of the first mid layer is defined as Hinm;

a volume ($mm^3$) of the second mid layer is defined as Vm;

a Shore D hardness of the second mid layer is defined as Hm;

a volume ($mm^3$) of the third mid layer is defined as Voum;

a Shore D hardness of the third mid layer is defined as Houm;

a volume ($mm^3$) of the cover is defined as Vc;

a Shore D hardness of the cover is defined as Hc; and a volume of an entirety of the golf ball is defined as V, the golf ball meets the following relational expressions (a) to (f):

$$Hinm<Hm>Houm>Hc, \quad (a)$$

$$Vinm<Vm>Voum>Vc, \quad (b)$$

$$Hm-Hc>25, \quad (c)$$

$$(Vinm+Vm+Voum+Vc)/V\leq 0.38, \quad (d)$$

$$Vm/Vc>1.50, \text{ and} \quad (e)$$

$$(Vm*Hm)/(Vc*Hc)>3.0; \quad (f)$$

wherein the Shore D hardness Hc of the cover is equal to or greater than 10 but equal to or less than 29, the volume Voum of the third mid layer is greater than the volume Vinm of the first mid layer, the volume Vinm of the first mid layer is equal to or greater than 2700 $mm^3$ but equal to or less than 4600 $mm^3$, the volume Vm of the second mid layer is equal to or greater than 3900 $mm^3$ but equal to or less than 5400 $mm^3$, the volume Voum of the third mid layer is equal to or greater than 3500 $mm^3$ but equal to or less than 4500 $mm^3$, and the volume Vc of the cover is equal to or greater than 1500 $mm^3$ but equal to or less than 3200 $mm^3$.

2. The golf ball according to claim 1, wherein the golf ball meets the following relational expression (g):

$$Vc/V<0.08. \quad (g)$$

3. The golf ball according to claim 1, wherein the second mid layer is formed from a resin composition, and a principal component of a base resin of the resin composition is selected from an ionomer resin, a polyamide resin, and a mixture thereof.

4. The golf ball according to claim 1, wherein the hardness Hm is equal to or greater than 68.

5. The golf ball according to claim 1, wherein a JIS-C hardness Hs at a surface of the core is greater than a JIS-C hardness Ho at a central point of the core, and a difference (Hs−Ho) between the hardness Hs and the hardness Ho is equal to or greater than 28.

6. The golf ball according to claim 1, wherein the hardness Hinm is less than the hardness Houm.

7. The golf ball according to claim 1, wherein the core is obtained by a rubber composition being crosslinked, and the rubber composition includes:

a co-crosslinking agent; and (A) a carboxylic acid and/or a salt thereof which can react with the co-crosslinking agent;

wherein the co-crosslinking agent is an α,β-unsaturated carboxylic acid having 2 to 8 carbon atoms, and/or a metal salt of an α,β-unsaturated carboxylic acid having 2 to 8 carbon atoms.

8. The golf ball according to claim 7, wherein the (A) carboxylic acid and/or salt thereof is an aromatic carboxylic acid and/or a salt thereof; or the (A) carboxylic acid and/or the salt thereof is a fatty acid and/or a salt thereof which excludes stearic acid and zinc stearate.

9. The golf ball according to claim 1, wherein a JIS-C hardness Hs at a surface of the core is equal to or greater than 84 but equal to or less than 96; and the Shore D hardness Hinm of the first mid layer is equal to or greater than 40 but equal to or less than 55.

10. A golf ball comprising a core, a mid layer positioned outside the core, and a cover positioned outside the mid layer, wherein the mid layer includes a first mid layer, a second mid layer positioned outside the first mid layer, and a third mid layer positioned outside the second mid layer, wherein when:

a volume ($mm^3$) of the first mid layer is defined as Vinm;

a Shore D hardness of the first mid layer is defined as Hinm;

a volume ($mm^3$) of the second mid layer is defined as Vm;

a Shore D hardness of the second mid layer is defined as Hm;

a volume ($mm^3$) of the third mid layer is defined as Voum;

a Shore D hardness of the third mid layer is defined as Houm;

a volume ($mm^3$) of the cover is defined as Vc;

a Shore D hardness of the cover is defined as Hc; and a volume of an entirety of the golf ball is defined as V, the golf ball meets the following relational expressions (a) to (f):

$$Hinm<Hm>Houm>Hc, \quad (a)$$

$$Vinm<Vm>Voum>Vc, \quad (b)$$

$$Hm-Hc>25, \quad (c)$$

$$(Vinm+Vm+Voum+Vc)/V\leq 0.38, \quad (d)$$

$$Vm/Vc>1.50, \text{ and} \quad (e)$$

$$(Vm*Hm)/(Vc*Hc)>3.0; \quad (f)$$

wherein the core is obtained by a rubber composition being crosslinked and the rubber composition of the core does not include esters of an aromatic carboxylic acid; and wherein the rubber composition comprises: a co-crosslinking agent and (A) a carboxylic acid and/or a salt thereof which can react with the co-crosslinking agent;

wherein the co-crosslinking agent is an α,β-unsaturated carboxylic acid having 2 to 8 carbon atoms; and/or a metal salt of an α,β-unsaturated carboxylic acid having 2 to 8 carbon atoms; and wherein the carboxylic acid and/or the salt thereof (A) is an aromatic carboxylic acid and/or a salt thereof.

11. The golf ball according to claim 1, wherein a thickness Tinm of the first mid layer is equal to or greater than 0.5 mm but equal to or less than 1.2 mm.

12. The golf ball according to claim 1, wherein a thickness Tm of the second mid layer is equal to or greater than 0.8 mm but equal to or less than 1.4 mm.

13. The golf ball according to claim 1, wherein a thickness Toum of the third mid layer is equal to or greater than 0.5 mm but equal to or less than 1.2 mm.

14. The golf ball according to claim 1, wherein a thickness Tc of the cover is equal to or greater than 0.1 mm but equal to or less than 0.6 mm.

15. The golf ball according to claim 1, wherein the core has a diameter of 36.0 mm or greater but 42.0 mm or less.

16. The golf ball according to claim 1, wherein the mid layer has an outer diameter of 40.9 mm or greater but 42.1 mm or less.

* * * * *